US010285515B1

(12) United States Patent
Desilets

(10) Patent No.: US 10,285,515 B1
(45) Date of Patent: May 14, 2019

(54) MOUNTING APPARATUS AND METHOD FOR USE

(71) Applicant: Brian Desilets, Simpsonville, KY (US)

(72) Inventor: Brian Desilets, Simpsonville, KY (US)

(73) Assignee: Brian Desilets, Simpsonville, KY (US)

( * ) Notice: Subject to any disclaimer, the term of this patent is extended or adjusted under 35 U.S.C. 154(b) by 0 days.

(21) Appl. No.: 15/682,071

(22) Filed: Aug. 21, 2017

(51) Int. Cl.
*F21V 21/00* (2006.01)
*A47F 5/08* (2006.01)

(52) U.S. Cl.
CPC ..... *A47F 5/0823* (2013.01); *A47F 5/083* (2013.01)

(58) Field of Classification Search
USPC ..... 248/222.31
See application file for complete search history.

(56) References Cited

U.S. PATENT DOCUMENTS 2,054,511 A * 9/1936 Hornicek ..... E04F 13/0803 52/385
2,300,258 A * 10/1942 Kublanow ..... E04F 13/0803 52/774
2,913,210 A * 11/1959 Tichnor ..... A47F 5/0823 211/87.01
3,850,396 A 11/1974 Orlandi
3,888,441 A * 6/1975 Rebentisch ..... H02G 3/263 248/73
4,434,960 A 3/1984 Berry
4,506,856 A * 3/1985 Rich ..... A47F 5/0823 248/220.31
5,379,976 A * 1/1995 DeGirolamo ..... A47F 5/0815 248/220.43
5,647,566 A * 7/1997 Kump ..... A47F 5/0823 248/220.21
5,653,348 A 8/1997 MacDonald
5,762,211 A 6/1998 Ensign
6,098,363 A * 8/2000 Yaguchi ..... E04F 13/0801 52/385
6,202,865 B1 3/2001 Kuo
6,748,629 B2 6/2004 Gould
7,392,912 B2 * 7/2008 Zandt ..... A47F 5/0823 211/57.1
7,617,646 B2 * 11/2009 Losse ..... E04F 13/14 52/385
8,118,267 B2 2/2012 Yu et al.
8,403,154 B2 3/2013 Smith et al.
8,459,472 B2 6/2013 Hofman
8,522,986 B2 * 9/2013 Kitchen ..... A47F 5/0815 211/59.1

(Continued)

FOREIGN PATENT DOCUMENTS

WO WO2010027342 A1 3/2010

*Primary Examiner* — Monica E Millner
(74) *Attorney, Agent, or Firm* — Middleton Reutlinger

(57) ABSTRACT

A mounting apparatus and a method relating to using the mounting apparatus. The mounting apparatus may include a mounting panel having a plurality of mounting holes and a plurality of apertures, and at least one utility bracket having at least one mounting mechanism and at least one anchor. Each of the plurality of apertures may include a first section having at least a pliable locking tab and a second section having at least a slot. The at least one anchor may include a left flange, a right flange, and a central spline. Each of the plurality of apertures of the mounting panel may be configured to receive the at least one anchor of the at least one utility bracket.

19 Claims, 9 Drawing Sheets

(56) References Cited

U.S. PATENT DOCUMENTS

| | | | | |
|---|---|---|---|---|
| 10,041,257 | B2 * | 8/2018 | Tancredi | E04F 13/0862 |
| 2006/0011794 | A1 * | 1/2006 | Zadak | A47F 5/0884<br>248/220.31 |
| 2006/0278782 | A1 * | 12/2006 | Lockwood | A47F 5/0823<br>248/220.31 |
| 2008/0169667 | A1 | 7/2008 | Siniarski et al. | |
| 2010/0116956 | A1 * | 5/2010 | DeVito | A47F 5/0823<br>248/220.41 |
| 2010/0327134 | A1 * | 12/2010 | Lundrigan | F16M 11/046<br>248/220.31 |
| 2014/0061402 | A1 * | 3/2014 | Bernstein | A47F 5/04<br>248/125.3 |
| 2014/0374549 | A1 | 12/2014 | Bernstein | |

* cited by examiner

MOUNTING APPARATUS AND METHOD FOR USE

CROSS-REFERENCE TO RELATED APPLICATIONS

None.

TECHNICAL FIELD

Generally, a mounting apparatus and method for using the mounting apparatus is taught.

BACKGROUND

Perforated storage boards are typically made of hardboard, wood, or metal, and have a plurality of holes that are evenly spaced. Generally, these perforated storage boards are referred to as pegboards and are designed to support pegs. These pegs are typically made of metal and may be any combination of hooks, rods, and/or prongs to support an object using normal gravitational forces. Commonly, pegboards are utilized in residential, industrial, and/or commercial settings due to their versatility. In a residential setting, a pegboard may be utilized to organize whatever a consumer desires, e.g., organize office supplies. In an industrial setting, a pegboard may be utilized to organize and hang tools. In a commercial setting, a pegboard may be utilized to display a retail price and to support a retail item.

Recently, pegboards have been made of various types of plastics and have been designed to receive various types of pegs. Further, the various types of pegs have moved away from simple metal hooks, rods, and/or prongs and have become customizable based on a desired application or use of the pegboard and/or the pegs. The results of plastic pegboards and customizable pegs are new innovations with respect to the interface between the pegboards and the pegs, and new applications due to the lightweight nature of plastics compared to hardboard, wood, or metal. For example, these innovations have allowed pegboard style apparatuses to expand from residential, industrial, and/or commercial settings to other settings, such as an automobile setting. In the automobile setting, pegboard style apparatuses may be built into the interior of an automobile and used to support accessories for a driver. However, many of these innovations still use normal gravitational forces to support the object.

Moreover, innovations that do not use normal gravitational force to support the object, such as clips and fasteners, are either fragile to secure and remove from the pegboard, or cannot be removed from the pegboard easily, and sometimes cannot be removed from the pegboard entirely. Therefore, a user may be forced to purchase more pegs or an entirely new pegboard.

There is a need in the art for a more durable and practical pegboard style mounting apparatus that allows a user to easily engage a peg to a pegboard and remove the peg from the pegboard.

SUMMARY

Generally, a mounting apparatus including a mounting panel and at least one utility bracket is taught. The mounting panel has a front side and a rear side. The front side including a plurality of mounting holes and a plurality of apertures, each of the apertures having both a first section and a second section. The first section including at least a pliable locking tab, wherein the pliable locking tab extends within the first section towards the second section, and the pliable locking tab movable between a rest position and a tension position. The second section including at least one slot for receiving that at least one utility bracket. The at least one utility bracket has a first side and a second side. The first side includes at least one mounting mechanism to support an object. The second side includes at least one anchor having a central spline and one or more lateral flanges. The at least one anchor is configured to move the pliable locking tab from the rest position to the tension position and slide down the at least one slot of the second section, and the pliable locking tab holds the at least one anchor in the rest position.

In some embodiments, the rear side of the mounting panel may include a rear cavity. The pliable locking tab may be received by the rear cavity in the tension position. Further, the pliable locking tab may be substantially parallel to the rear side of the mounting panel in the rest position.

In some embodiments, the plurality of mounting holes on the front side of the mounting panel may be straight. In other embodiments, embodiments, the plurality of mounting holes on the front side of the mounting panel may be angled.

In some embodiments, the pliable locking tab may be laterally tapered creating a tapered end. The tapered end of the pliable locking tab may abut the at least one anchor and hold the at least one anchor of the at least one utility bracket to the mounting panel.

In some embodiments, the second section may include one or more lead-ins disposed proximate to the at least one slot, such that the one or more lead-ins extend from the front side of the mounting panel to the rear side of the mounting panel In some embodiments, the one or more lateral flanges may include a first lateral flange, the first lateral flange laterally extending from the central spline. Further, the one or more lateral flanges may include a second lateral flange, the second lateral flange laterally extending from the central spline and substantially opposite the first lateral flange.

In some embodiments, the at least one utility bracket may have the at least one anchor including a first anchor and a second anchor. The first anchor including a first later flange laterally extending from the central spline, and the second anchor including a second lateral flange laterally extending from a second central spline in a substantially opposite direction from the first lateral flange.

In some embodiments, the at least one mounting mechanism may be one or more straps to support the object. In other embodiments, the at least one mounting mechanism may be one or more prongs to support the object. In yet other embodiments, the at least one mounting mechanism may be a cavity to support the object.

Generally, in another aspect, a mounting panel is taught. The mounting panel having a front side and a rear side. The front side including a plurality of mounting holes and a plurality of apertures, and the rear side including a rear cavity. Each of the apertures of the front side having a first section and a second section. The first section includes at least a pliable locking tab extending within the first section towards the second section, and the second section includes at least a slot for receiving at least one utility bracket. The pliable locking tab movable between a rest position and a tension position, wherein the pliable locking tab has a first lateral side and a second lateral side. At least one of the first lateral side and the second lateral side is laterally tapered creating a tapered end. The tapered end of the pliable locking tab is adjacent the intersection of the first section and the at least one slot of the second section in the rest position.

Further, the tapered end of the pliable locking tab is received by the rear cavity when in the tension position.

In some embodiments, the combination with the at least one utility bracket may include a first side and a second side. The first side may include at least one mounting mechanism to support an object, and the second side may include at least one anchor, the at least one anchor having a central spline and one or more lateral flanges. The at least one anchor moves the pliable locking tab from the rest position to the tension position to be received by the slot of the second section.

In some embodiments, the tapered end may be in the tension position when the tapered end is away from the slot, such that the at least one utility bracket may be removed from the at least one slot of the second section of the aperture. The second section may further include one or more lead-ins disposed proximate to the at least one slot, the one or more lead-ins extending from the front side of the mounting panel to the rear side of the mounting panel, and the one or more lead-ins may be configured to receive one or more of the lateral flanges.

In some embodiments, the at least one mounting mechanism may be one or more straps to support the object. In other embodiments, the at least one mounting mechanism may be one or more prongs to support the object. In yet other embodiments, the at least one mounting mechanism may be a cavity to support the object.

Generally, in yet another aspect, a method of using a mounting apparatus is taught. The method includes securing a mounting panel to a surface, by a plurality of mounting holes, the plurality of mounting holes disposed through the mounting panel, the mounting panel including a front side, a rear side, a rear cavity, and a plurality of apertures. Each of the plurality of apertures having a first section and a second section. The first section including at least a pliable locking tab, the pliable locking tab extending within the first section towards the second section and moveable between a rest position and a tension position, the pliable locking tab laterally tapered creating a tapered end. The second section of each of the apertures including a slot. The method further including the step of inserting at least one utility bracket into one or more of the plurality of apertures towards the slot by moving the pliable locking tab to the tension position. The at least one utility bracket including a first side and a second side. The first side having at least one mounting mechanism to support an object, and the second side having at least one anchor including a central spline and one or more lateral flanges. The method further including the step of locking the at least one utility bracket within the second section when the pliable locking tab is in the rest position.

In some embodiments, the method may further include the step of removing the at least one utility bracket from the second section by moving the pliable locking tab to the tension position.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, emphasis instead being generally placed upon illustrating the principles of the embodiments depicted.

DETAILED DESCRIPTION

Figure 1:
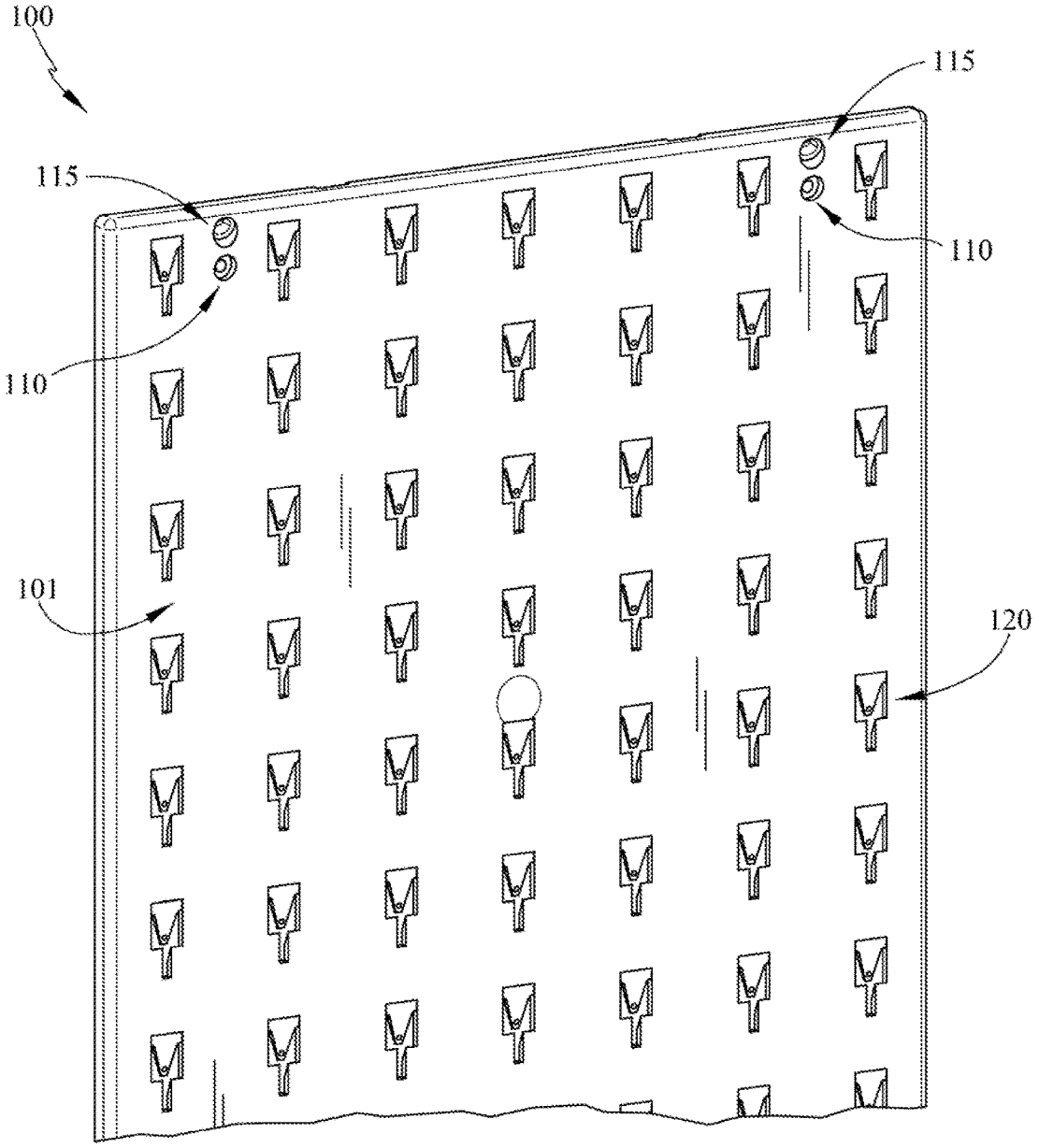
FIG. 1 is a perspective view of a portion of an mounting panel according to one embodiment herein.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Figure 2A:
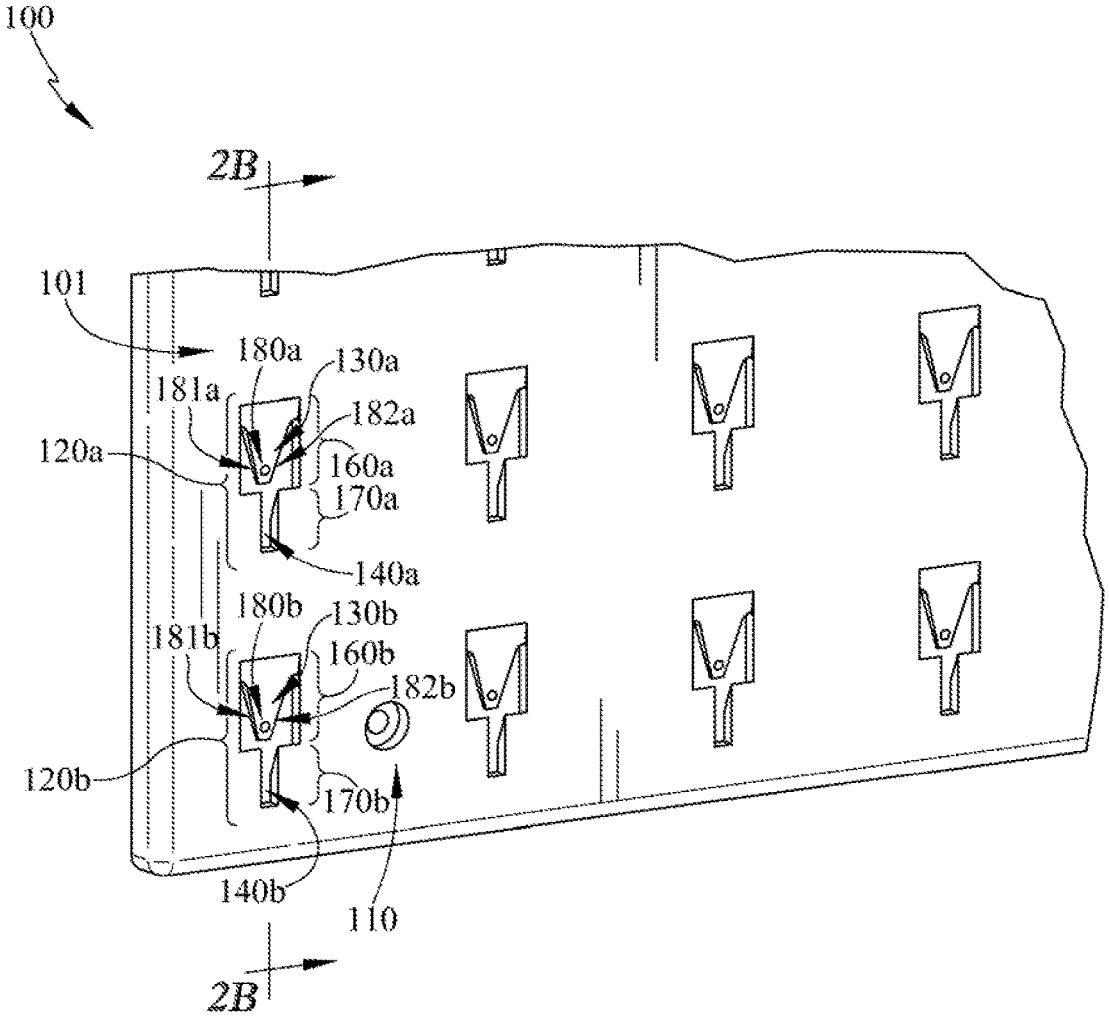
FIG. 2A is a perspective view of a plurality of exemplary apertures of a portion of the mounting panel according to FIG. 1.
Figure 2B:
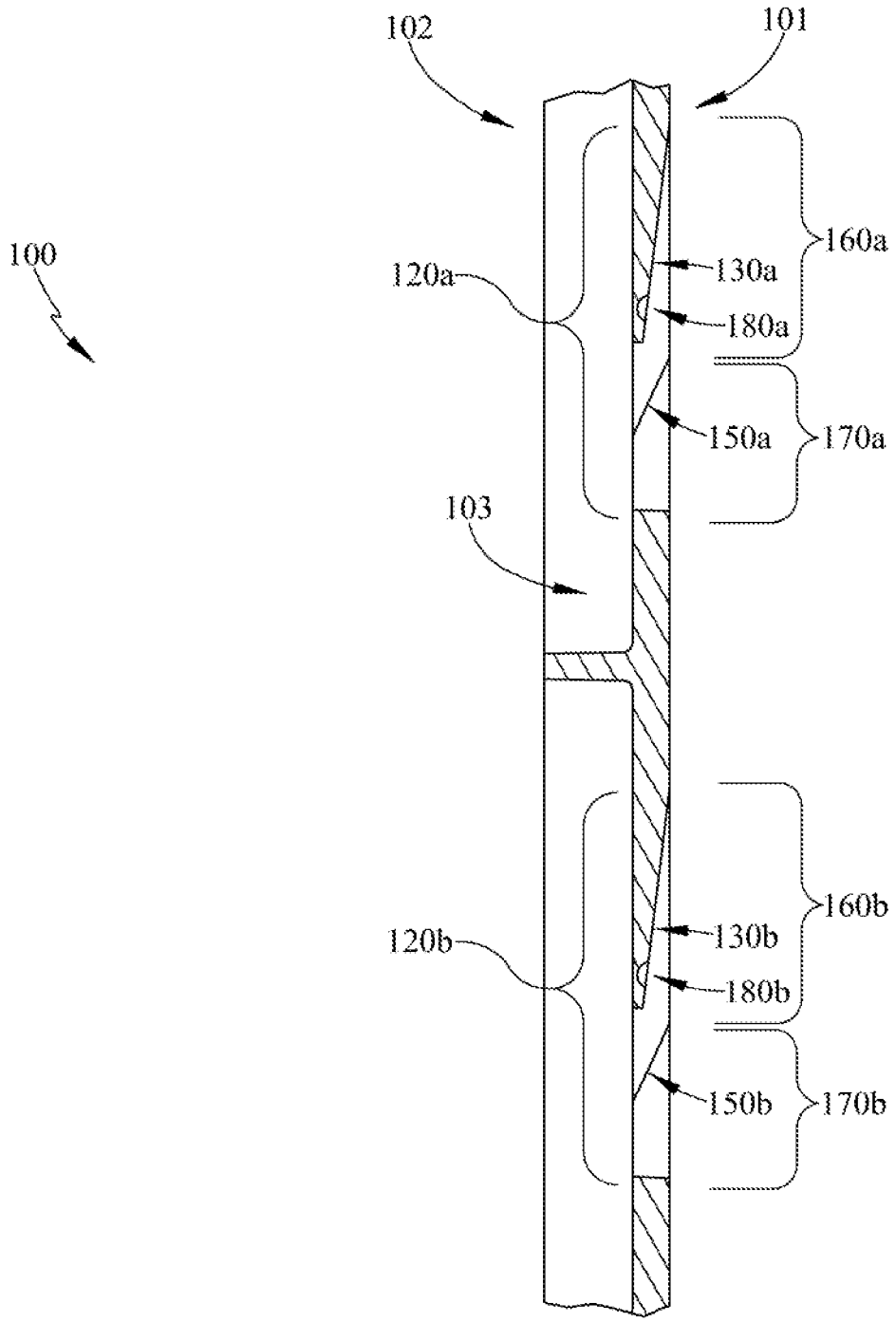
FIG. 2B is a sectional view of the plurality of exemplary apertures according to FIG. 2A taken along line 28-2B.

Referring initially to FIGS. 1-2B, a perspective view of a portion of a mounting panel 100 is illustrated. The mounting panel 100 has a front side 101 and a rear side 102. The front side 101 includes a plurality of straight mounting holes 110, a plurality of angled mounting holes 115, and a plurality of apertures 120. The mounting panel 100 may be secured to various surfaces by the plurality of straight mounting holes 110 and/or the plurality of angled mounting holes 115. The plurality of angled mounting holes 115 may create acute or obtuse angles with the front side 101 of the mounting panel. For example, in a residential setting, the mounting panel 100 may be secured to a door. As another example, in an industrial setting, the mounting panel 100 may be secured to a vertical panel of a workbench. As yet another example, in a commercial setting, the mounting panel 100 may be secured to a wall or existing shelving.

The mounting panel 100 may be secured to these various surfaces by inserting a plurality of removable securing devices, such as screws, nails, or the like, through one or more of the plurality of straight mounting holes 110 and/or one or more of the plurality of angled mounting holes 115. This allows the mounting panel 100 to be secured to a surface using the plurality of removable securing devices, and circumvents the need to hang the mounting panel 100 with hangers or another type of device. The plurality of straight mounting holes 110 allow the mounting panel 100 to be secured directly to a surface and their use may be more advantageous for thick surfaces, such as a wall. The plurality of angled mounting holes 115 allow the mounting panel 100 to be secured directly to a surface and their use may be more advantageous for thin surfaces because they provide additional support.

This additional support may be a result of the mounting panel 100 being mounted into a door frame, which would require a larger force to remove the mounting panel 100, and may be necessary in some situations. For example, if the mounting panel 100 is to be secured to a hollow door of a softwood door, then it may be desirable to utilize the plurality of angled mounting holes 115, rather than the straight mounting holes 110 because a fastening device, such as a screw, may easily be stripped or come undone. As another example, if the mounting panel 100 is to be secured to a solid door of a hardwood door, then it may be desirable to utilize the plurality of straight mounting holes 110, rather than the angled mounting holes 115 because the fastening device may not easily be stripped or come undone.

Although the plurality of apertures 120 on the front side 101 of the mounting panel 100 are depicted as an N×7 matrix (where N is a whole integer number greater than eight), this is for exemplary purposes only and not meant to be limiting. For example, the plurality of apertures 120 may be a single row or a single column. As another example, the plurality of apertures 120 may be evenly spaced rows and columns. Further, either the rows or the columns may be offset. Each of the plurality of apertures 120 may be designed based a desired application of the mounting panel 100.

Referring now to FIGS. 2A-2B, a perspective view and sectional view of the plurality of apertures 120 of a portion of the mounting panel 100 according to FIG. 1 are illustrated. Each of the plurality of apertures are substantially similar and, for the sake of brevity, reference will be made to a first aperture 120*a*. The first aperture 120*a* may be disposed on the front side 101 of the mounting panel 100 and may have a first section 160*a* including at least a first pliable locking tab 130*a*. Further, the first aperture 120*a* may have a second section 170*a* including at least a first slot 140*a*.

"Pliable" refers to the ability to easily bias the first pliable locking tab 130*a* in one or more directions. This pliability allows the first pliable locking tab 130*a* to be biased time and time again without breaking. The first pliable locking tab 130*a* may extend within the first section 160*a* towards the second section 170*a*. Further, the first pliable locking tab 130*a* may have both a first lateral side 181*a* and a second lateral side 182*a*.

In some embodiments, the first pliable locking 130*a* may be laterally tapered on both the first lateral side 181*a* and the second lateral side 182*a* creating a tapered end 180*a*. The tapered end 180*a* of the first pliable locking tab 130*a* may allow the first pliable locking tab 130*a* to move between a rest position and a tension position. The tapered end 180*a* may be adjacent to the intersection of the first section 160*a* and the first slot 140*a* of the second section 170*a* in the rest position, and the tapered end 180*a* may be received by a rear cavity 103 (see FIG. 2B) in the tension position, such that the tapered end 180*a* moves away from the slot 140*a*. The first pliable locking tab 130*a* and the movement of the tapered end 180*a* between the rest position and the tension position will be further discussed hereinafter with respect to FIGS. 3A-3B.

In other embodiments, the first pliable locking tab 130*a* may be tapered on the front side 101 of the mounting panel 100 as it extends within the first section 160*a* towards the second section 170*a*. The size and shape of the first pliable locking tab 130*a* may depend on a desired application of the mounting panel 100. For example, if a user desires to mount a garden house, then the first pliable locking 130*a* may be longer, thicker, and less tapered to support the weight of the garden hose than if the user desires to mount a necklace display.

In some embodiments, the first slot 140*a* may be rectangular and have a larger height than length. However, this is not meant to be limiting. For example, the first slot 140*a* may be rectangular and have a larger length than height. In other embodiments, the first slot 140*a* may be circular. The shape and size of the first slot 140*a* may depend on a desired application of the mounting panel 100. The first slot 140*a* will be further discussed hereinafter with respect to FIGS. 3A-3B.

Referring now to FIG. 2B, a sectional view of the first aperture 120*a* and a second aperture 120*b* according to FIG. 2A is illustrated. From the side view, only the first aperture 120*a* and the second aperture 120*b* may be seen. In this embodiment, the first aperture 120*a* and the second aperture 120*b* are substantially similar and, for the sake of brevity, reference will be made to the first aperture 120*a*. The rear side 102 of the mounting panel 100 may further include a rear cavity 103. The rear cavity 103 provides clearance for the first pliable locking tab 130*a* to move from the rest position to the tension position, which will be discussed in more detail hereinafter with respect to FIGS. 3A-3B.

The second section 170*a* may further include one or more lead-ins and, for the sake of brevity, reference will be made to a first lead-in 150*a*. The first lead-in 150*a* may be disposed proximate to the first slot 140*a* and extend from the front side 101 of the mounting panel 100 to the rear side 102 of the mounting panel 100. In some embodiments, the first lead-in 150*a* may be angled such that it increases in slope as it extends from the front side 101 to the rear side 102. In other embodiments, the first lead-in 150*a* may be angled such that it decreases in slope as it extends from the front side 101 to the rear side 102. The functionality of the at least first lead-in 150*a* will be further discussed hereinafter with respect to FIGS. 3A-3B.

Figure 3A:
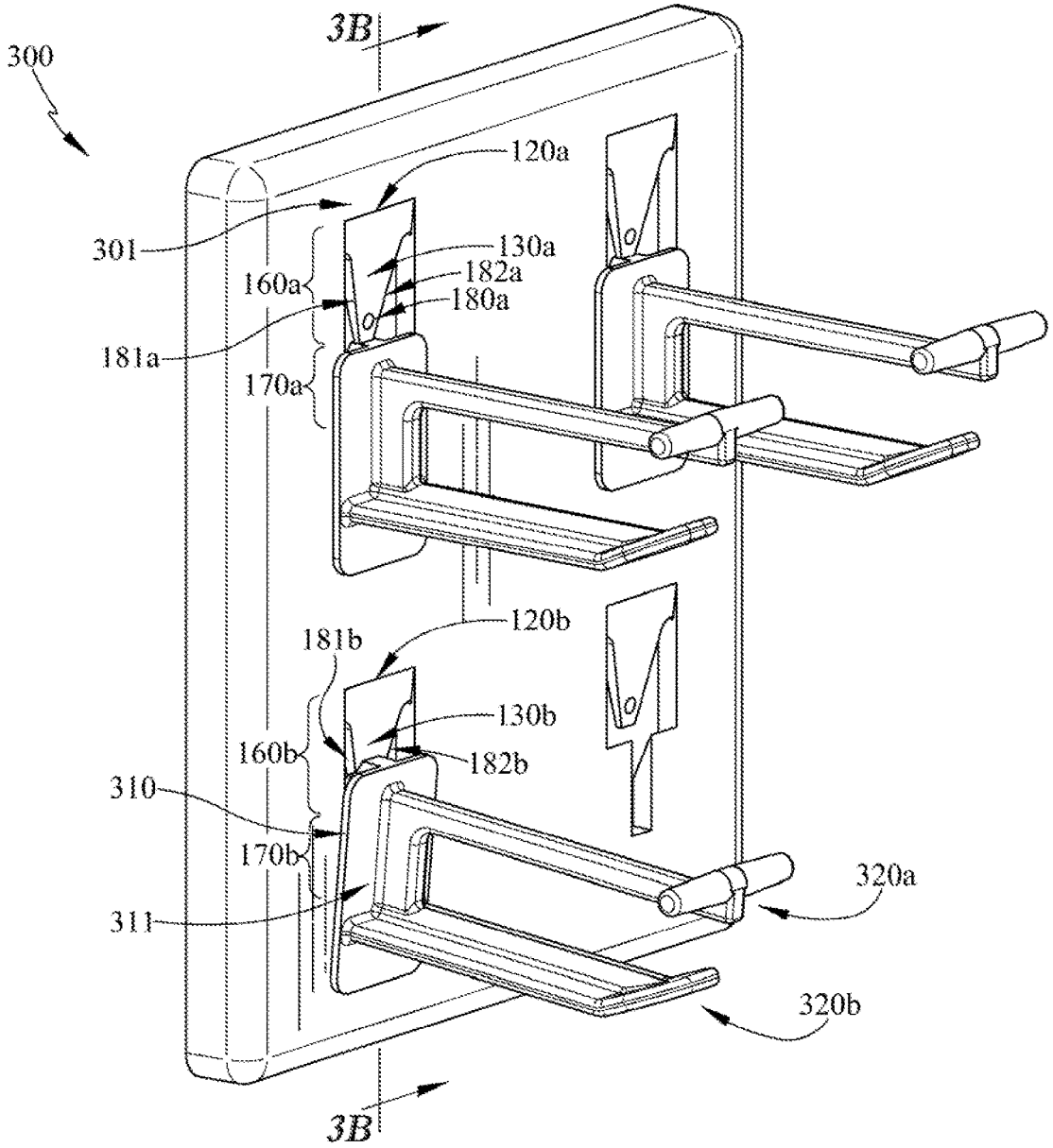
FIG. 3A is a perspective view of an mounting panel and an utility bracket according to one embodiment herein.
Figure 3B:
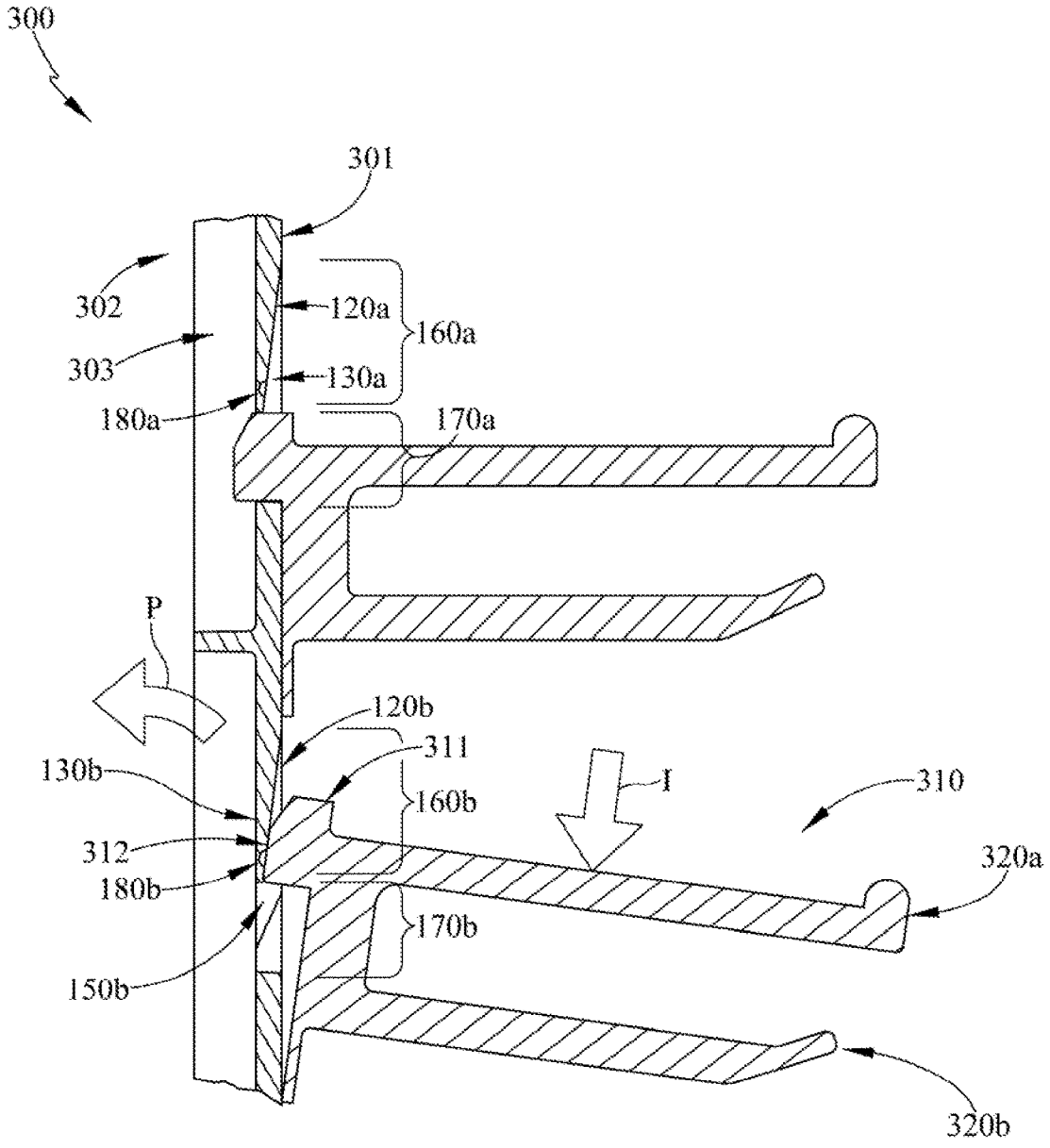
FIG. 3B is a sectional view of the mounting panel and the utility bracket according to FIG. 3A taken along line 3B-3B.

Referring now to FIGS. 3A-3B, a perspective view of a mounting panel 300 and a utility bracket 310 is illustrated, and a sectional view of the mounting panel 300 and the utility bracket 310 according to FIG. 3A is illustrated, respectively. The mounting panel 300 has at least a front side 301 and a plurality of apertures 120. Each of the plurality of apertures are substantially similar and, for the sake of brevity, reference will be made to a first aperture 120*a*. The first aperture 120*a* may have a first section 160*a* including at least a first pliable locking tab 130*a* and a second section 170*a* including at least a first slot 140*a*. The first slot 140*a* may be configured to receive the utility bracket 310.

Figure 3C:
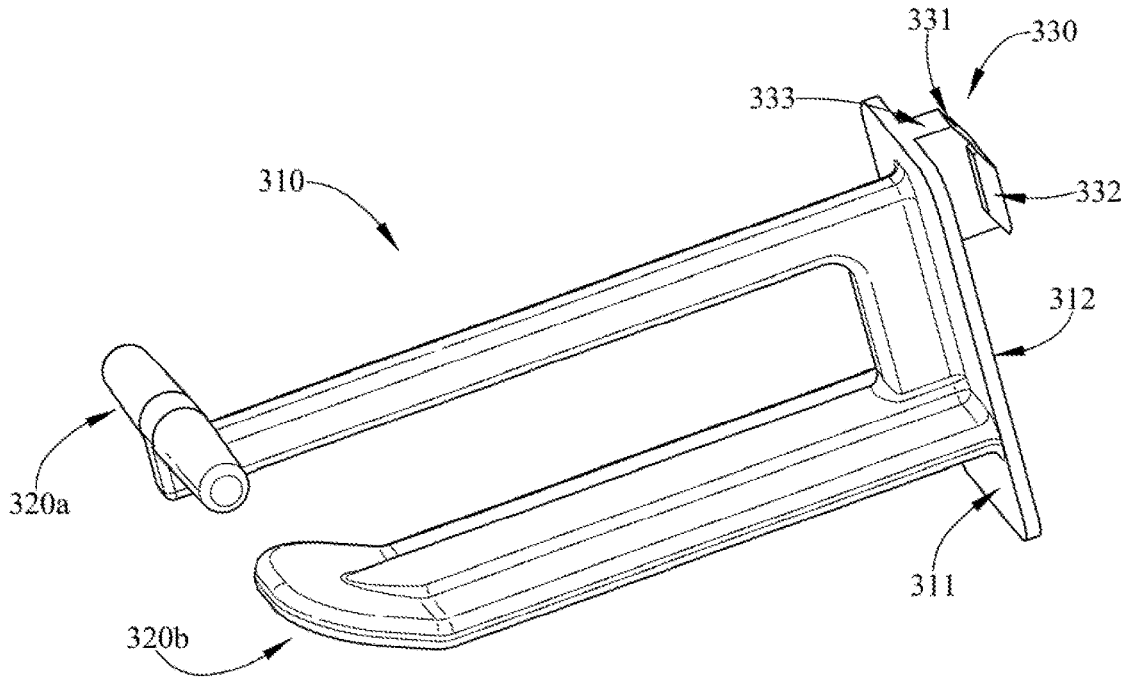
FIG. 3C is a perspective view of the utility bracket according to FIG. 3A and FIG. 3B.

Referring briefly to FIG. 3C, a perspective view of the utility bracket 310 according to FIGS. 3A-3B is illustrated. The utility bracket 310 may have a first side 311 including at least one of a first mounting mechanism 320*a* and a second mounting mechanism 320*b* to support an object and may have a second side 312 including an anchor 330. The anchor 330 may include a first lateral flange 331, a second lateral flange 332, and a central spline 333. Further, the utility bracket 310 may be received by the first aperture 120*a* of the mounting panel 300.

In some embodiments, the utility bracket 310 may include one or more mounting mechanisms. For example, if only the first mounting mechanism 320*a* is utilized, then the first mounting mechanism 320*a* may be used to support an article of clothing. In the other embodiment shown in FIGS. 3A-3B, there may be one or more mounting mechanisms 320*a*-320*b*. For example, if both the first mounting mechanism 320*a* and the second mounting mechanism 320*b* are utilized, then the first mounting mechanism 320*a* may be used to support an article of clothing and the second mounting mechanism 320*b* may be used to support a display corresponding to the article of clothing, such as a price or a description.

In some embodiments, the first mounting mechanism 320*a* and the second mounting mechanism 320*b* may be one or more prongs as illustrated in FIGS. 3A-3C. The one or more prongs may be parallel, perpendicular, or oriented at some other angle with respect to the mounting panel 300. In some embodiments, the first mounting mechanism 320*a* and the second mounting mechanism 320*b* may be one or more straps. The one or more straps may be adjustable to secure various types of objects. In other embodiments, the at least one mounting mechanism may be any combination of the foregoing mounting mechanisms. The type of mounting mechanism utilized may depend a desired application of the mounting apparatus.

As illustrated in FIG. 3C, the second side 312 of the utility bracket 310 may include one or more anchors 330. Although only the anchor 330 is used, the second side 312 of the utility bracket 310 may include a plurality of anchors in some embodiments. The number of anchors included on the second side 312 of the utility bracket 310 may be based on a desired application or use of the mounting apparatus. For example, if an object that will be supported by at least one mounting mechanism has a weight of one pound, then the second side 312 of the utility bracket 310 may have one anchor due to the weight of the object. As another example, if an object that will be supported by at least one mounting mechanism has a weight of ten pounds, then the second side 312 of the utility bracket 310 may have two or more anchors due to the weight of the object.

The size and shape of the anchor 330 may depend on at least one of the size and shape of the first aperture 120*a* and a desired application or use of the mounting apparatus. In some embodiments, the anchor 330 may include a first lateral flange 331 and a central spline 333. In other embodiments, the anchor 330 may include a second lateral flange 332 and the central spline 333. In yet other embodiments, the anchor 330 may include the first lateral flange 331, the second lateral flange 332, and the central spline 333. In some embodiments, each of the first lateral flange 331 and the second lateral flange 332 may laterally extend from the central spline 333. In other embodiments, each of the first lateral flange 331 and the second lateral flange 332 may perpendicularly extend from the central spline 333. One or more of the first lateral flange 331 and the second lateral flange 332, and the central spline 333 of the anchor 330 may be received by the first aperture 120*a*.

Referring back to FIGS. 3A-3B, the interface between the mounting panel 300 and the utility bracket 310, and a method for securing the utility bracket 310 to the mounting panel 300 will be discussed. The front side 301 of the mounting panel 300 is illustrated as having a plurality of apertures, but reference will be made to the first aperture 120*a* and a second aperture 120*b*, for the sake of brevity. A plurality of utility brackets are substantially similar, so reference will be made to the utility bracket 310, for the sake of brevity.

The anchor 330 on the second side 312 of the utility bracket 310 may be inserted I into a first section 160*b* of the second aperture 120*b*. The central spline 333 of the anchor 330 may be configured to push back a tapered end 180*b* of a second pliable locking tab 130*b* moving the second pliable locking tab 130*b* from a rest position to a tension position, such that a rear cavity 303 of the rear side 302 receives the second pliable locking tab 130*b* in the tension position. As the utility bracket 310 is inserted I into the second aperture 120*b*, pressure P may be applied to the utility bracket 310, such that the central spline 333 engages the tapered end 180*b* of the second pliable locking tab 130*b*. The anchor 330 may slide down into a second section 170*b* of the second aperture 120*b*. As the anchor 330 slides into the second section 170*b*, a second lead-in 150*b* may extend from the front side 301 of the mounting panel 300 to the rear side 302 of the mounting panel 300. The second lead-in 150*b* may be angled to guide the first lateral flange 331 and/or the second lateral flange 332 of the anchor 330 into a second slot 140*b* (FIG. 2A) of the second section 170*b* of the second aperture 120*b*.

Once the anchor 330 is received by the second slot 140*b* of the second section 170*b*, the utility bracket 310 inserted in the second aperture 120*b* will look substantially similar to the utility bracket 310 inserted into the first aperture 120*a*. The first pliable locking tab 130*a* will move from the tension position (e.g., the second pliable locking tab 130*b*) back to the rest position (e.g., the first pliable locking tab 120*a*) and the tapered end 180*a* may abut the central spline 333 and hold the utility bracket 310 to the mounting panel 300. In this position, the utility bracket 310 is prevented from further movement, the anchor 330 is in alignment with the second slot 140*b*, and the first mounting mechanism 320*a* and the second mounting mechanism 320*b* are substantially perpendicular to the mounting panel 300. An object may be placed on and/or attached to at least one of the first mounting mechanism 320*a* and the second mounting mechanism 320*b*.

The utility bracket 310 may remain secured to the mounting panel 300 until it is removed. To remove the utility bracket 310 from the first aperture 120*a* of the mounting panel 300, pressure may be applied to the tapered end 180*a* of the first pliable locking tab 130*a* to move the first pliable locking tab 130*a* from the rest position to the tension position. If a sufficient force is applied to the tapered end 180*a* of the third pliable locking tab 130*c*, the tapered end 180*a* is disengaged from the central spline 333 of the anchor 330 and the utility bracket 310 may be lifted upwards and outwards for removal. The second lead-in 150*b* may guide the anchor 330 of the utility bracket 310 from the second slot 140*b* of the second section 170*b* of the second aperture 120*b* to the first section 160*b* of the second aperture 120*b* such that it may be removed from the mounting panel 300. After the utility bracket 310 is removed, another utility bracket, such as those in FIG. 4 and FIG. 5A, may be inserted in the third aperture 120*c* and/or the utility bracket 310 may be inserted into another one or more of the plurality of apertures.

Figure 4:
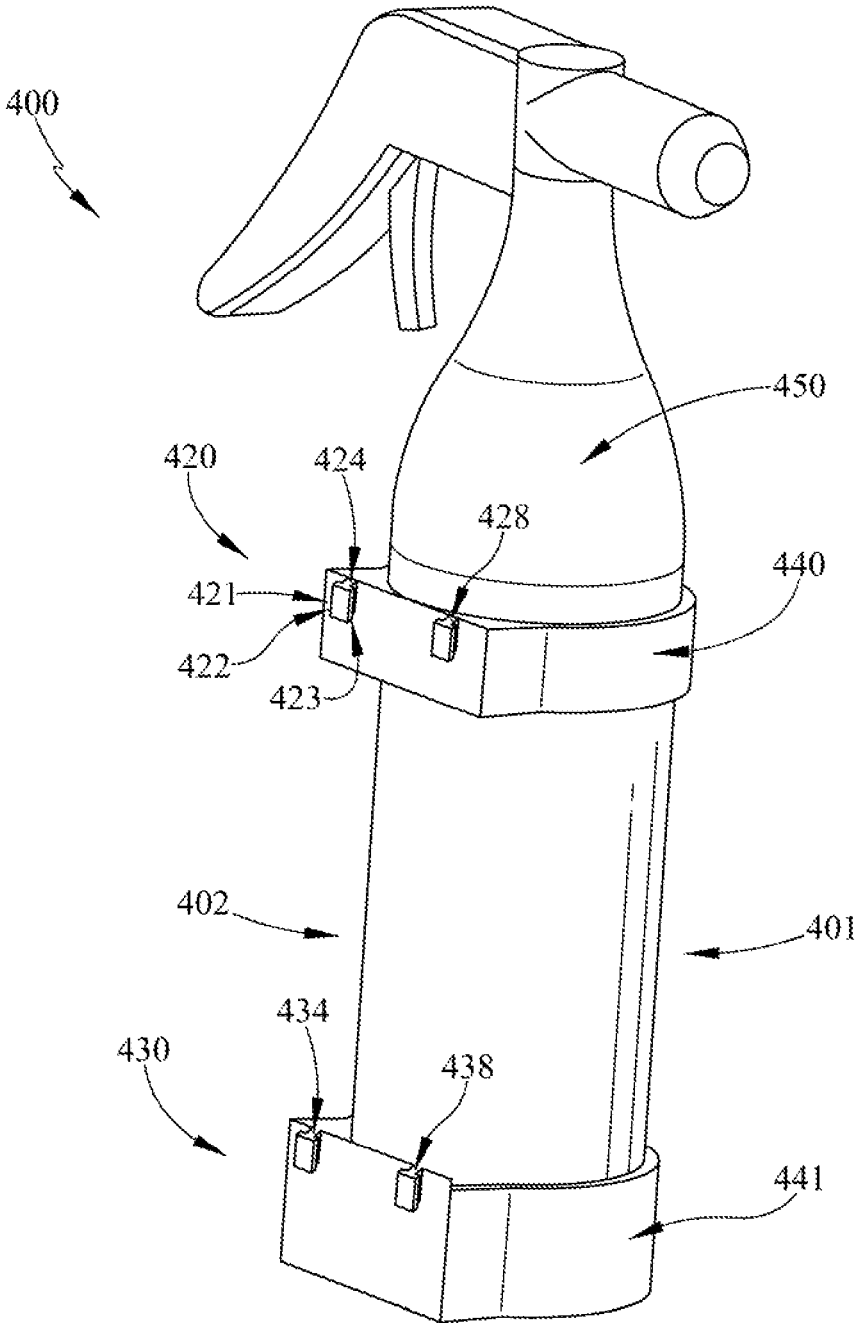
FIG. 4 is a perspective view of another utility bracket according to one embodiment herein.

Referring now to FIG. 4, a perspective view of another utility bracket 400 is illustrated. The utility bracket 400 may have a front side 401 and a rear side 402. The front side 401 may include at least one mounting mechanism. In some embodiments, the at least one mounting mechanism may include a first strap 440 or a second strap 441. In the embodiment shown, the at least one mounting mechanism may include both the first strap 440 and the second strap 441. The number of mounting mechanisms may depend on an application of the mounting apparatus. Each of the first strap 440 and the second strap 441 may be made of a durable, flexible material, such as, but not limited to, nylon, leather, polyester, or polypropylene. Further, each of the first strap 440 and the second strap 441 may be adjustable in length to ensure that an object may be secured therein by tightening or loosening each of the first strap 440 and the second strap 441.

The rear side 402 may include an upper utility bracket 420 and a lower utility bracket 430. In some embodiments, the utility bracket 400 may include the upper utility bracket 420, the lower utility bracket 430, and one or more additional utility brackets. In other embodiments, the utility bracket 400 may only include the lower utility bracket 430. The number of utility brackets may depend on a desired application of the mounting apparatus.

In some embodiments, the spacing between the upper utility bracket 420 and the lower utility bracket 430 may be adjustable. For example, if an object to be supported by the upper utility bracket 420 and the lower utility bracket 430 is a fire extinguisher 450, then the lower utility bracket 430 may be secured to a lower portion of the fire extinguisher 450 and the upper utility bracket 420 may be secured to an upper portion of the fire extinguisher 450. The spacing between the upper utility bracket 420 and the lower utility bracket 430 may depend on the spacing between the plurality of apertures of a mounting panel. In other embodiments, only the lower utility bracket 430 may be utilized, and the location of the lower utility bracket 430 may be fixed. For example, if an object to be supported by the lower utility bracket 430 is a fire extinguisher 450, then the lower utility bracket 430 may be secured to a lower portion of the fire extinguisher 450.

The upper utility bracket 420 may include a first anchor 421 and a second anchor 428, and the lower utility bracket 430 may include a third anchor 434 and a fourth anchor 438. Each of the upper utility bracket 420 and the lower utility bracket 430 may include at least one anchor. In some embodiments, the upper utility bracket 420 and the lower utility bracket 430 may include two anchors 421, 428 and 434, 438, respectively. In other embodiments, the upper utility bracket 420 and the lower utility bracket 430 may include more than two anchors. The number of anchors for the utility bracket 400 may depend on an application of the mounting apparatus.

Each of the first anchor 421, the second anchor 428, the third anchor 434, and the fourth anchor 438 are substantially similar, so reference will be made to the first anchor 421, for the sake of brevity. In some embodiments, the first anchor 421 may include one or more of a first lateral flange 422 and a second lateral flange 423, and a central spline 424. In other embodiments, the first anchor 421 may include both of the first lateral flange 422, the second lateral flange 423, and the central spline 424. The method for securing and removing the upper utility bracket 420 and the lower utility bracket 430 is substantially similar to that discussed in FIGS. 3A-3B.

The first anchor 421 of FIG. 4 may be smaller than the anchor 330 of FIGS. 3A-3B. However, this is not meant to be limiting. The size of the first anchor 421 may depend on at least one of the size of an aperture that is configured to receive the first anchor 421 and a desired application of the mounting apparatus.

Figure 5A:
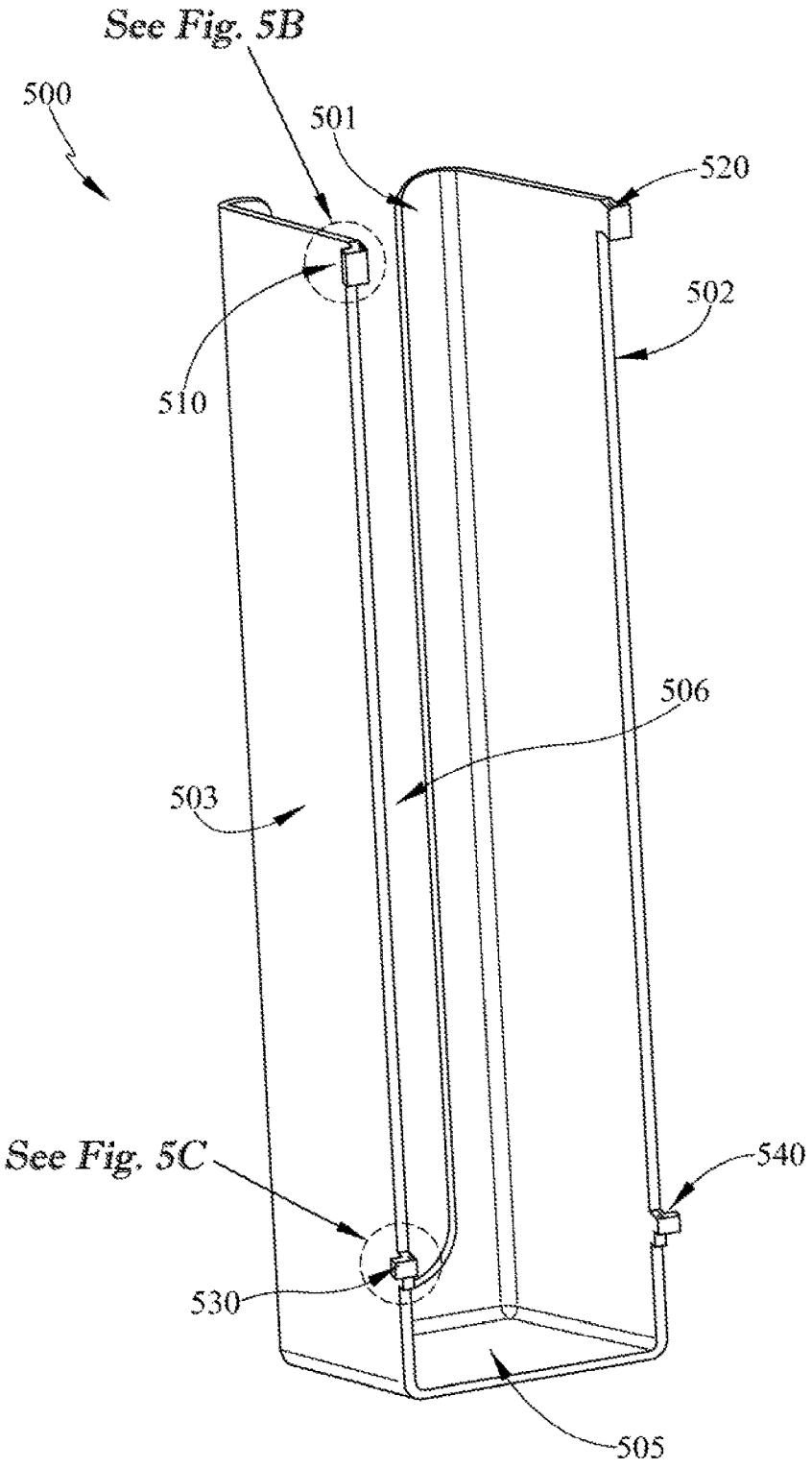
FIG. 5A is a perspective view of another utility bracket according to one embodiment herein.
Figure 5B:
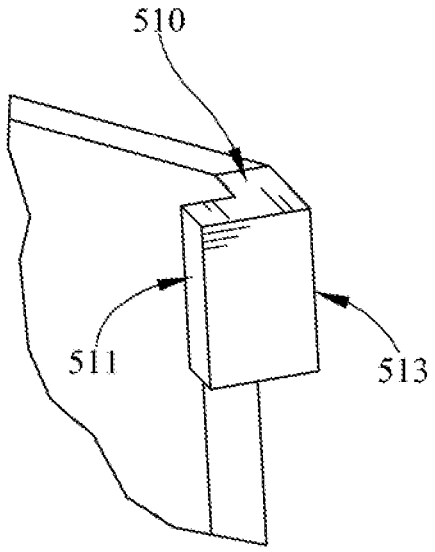
FIG. 5B is a close-up, perspective view of a top anchor according to FIG. 5A.
Figure 5C:
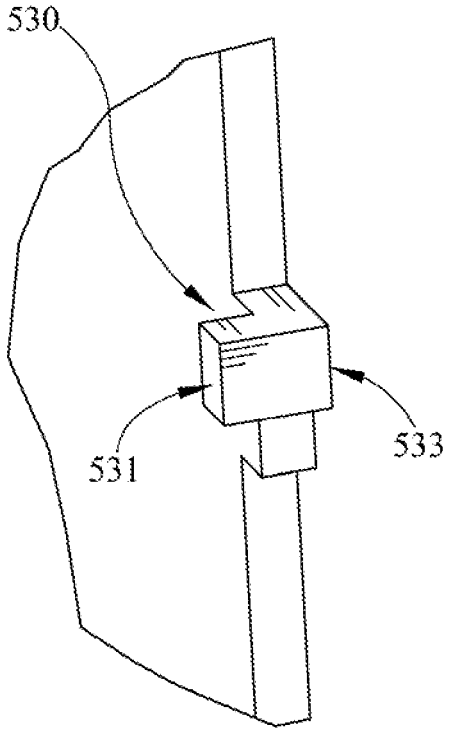
FIG. 5C is a close-up, perspective view of a bottom anchor according to FIG. 5A.

Referring now to FIGS. 5A-5C, a perspective view of another utility bracket 500 and close-up perspective views of a first anchor 510 and a third anchor 530 are illustrated. The utility bracket 500 may be rectangular and may have a front side 501, a rear side 502, a first side 503, a second side 504 (not illustrated), and a third side 505. The length of the first side 503 and the second side 504 may depend on a desired application of the utility bracket 500. An object may rest on the third side 505 of the utility bracket 500. The front side 501, the first side 503, the second side 504, and the third side 505 create a cavity 506 therewithin. The cavity allows an object to rest on the third side 505 of the utility bracket 500. For example, a roll of aluminum foil may rest on the third side 505 of the utility bracket 500, and a user may access the roll of aluminum foil through the cavity 506 as needed. One of skill in the art will recognize that the size and shape of the cavity 506 may depend on a desired application of the mounting apparatus.

The rear side 502 may include each of the first anchor 510, a second anchor 520, the third anchor 530, and a fourth anchor 540. In some embodiments, the rear side 502 may include one of the first anchor 510, the second anchor 520, the third anchor 530, and the fourth anchor 540. In other embodiments, the rear side may include the third anchor 530 and the fourth anchor 540. The number of anchors on the rear side 502 of the utility bracket 500 may depend on a desired application of the mounting apparatus. The first anchor 510 and the second anchor 520 are substantially similar, so reference will be made to the first anchor 510 (see FIG. 5B), for the sake of brevity. The third anchor 530 and the fourth anchor 540 are substantially similar, so reference will be made to the third anchor 530 (see FIG. 5C), for the sake of brevity.

Referring now to FIGS. 5B-5C, close-up, perspective views of the first anchor 510 and the third anchor 530 according to FIG. 5A are illustrated, respectively. In the shown embodiment, the first anchor 510 includes a first lateral flange 511 and a central spline 513, and the third anchor 530 includes a first lateral flange 531 and a central spline 533. In other embodiments, the first anchor 510 may include a second lateral flange extending in substantially opposite direction from the first lateral flange 511, and the central spline 513 (e.g., the second anchor 520), and the third anchor 530 may include a second lateral flange and the central spline 533 extending in substantially opposite direction from the first lateral flange 531 (e.g., the fourth anchor 540).

In the shown embodiment, the first lateral flange 531 of the third anchor 530 may be a half-length than the first lateral flange 511 of the first anchor 510. The half-length may provide a clearance area for the third anchor 530 and the fourth anchor 540. This clearance area may be necessary in certain situations. For example, if the utility bracket 500 includes the first anchor 510 and the third anchor 530 such that the first anchor 510 and the third anchor 530 are coupled to the rear side 502 of the utility bracket, then this clearance may be necessary for the third anchor 530 because the rear side 502 may prevent a user from applying pressure to a pliable locking tab to remove the utility bracket 500. The method for securing and removing the utility bracket 500 is substantially similar to that discussed in FIGS. 3A-3B. The third anchor 530 and the fourth anchor 540 may be inserted into an aperture via a slot, respectively. The first anchor 510 and the second anchor 520 may be inserted into an aperture via a slot, respectively. Pressure may be applied until each of the first anchor 510, the second anchor 520, the third anchor 530, and the fourth anchor 540 are locked into place by a tapered end of a pliable locking tab. The utility bracket 500 may be removed by applying pressure to each of the tapered ends of the pliable locking tabs securing the first anchor 510 and the second anchor 520 into place. Once a sufficient force is applied to the tapered ends, the utility bracket 500 may be lifted upwards and outwards.

The first anchor 510 of FIGS. 5A-5B and the third anchor 530 of FIGS. 5A-5C may be smaller than the first anchor 421 of FIG. 4 and/or the anchor 330 of FIGS. 3A-3C. However, this is not meant to be limiting. The size of the first anchor 510 and the third anchor 530 may depend on at least one of the size of an aperture that is configured to receive the first anchor and a desired application of the mounting apparatus.

The mounting apparatus disclosed herein may be made by a variety of different methods from a variety of materials. In some embodiments, the mounting apparatus may be manufactured via injection molding. If the mounting apparatus is injection molded, then the material may be, but is not limited to, elastomers, thermosetting polymers, polyurethane, or any other polymer. In other embodiments, the mounting apparatus may be manufactured via 3D printing. If the mounting apparatus is 3D printed, then the material may be, but is not limited to powders, elastomers, thermosetting polymers, polyurethane, or any other polymer.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

It should also be understood that, unless clearly indicated to the contrary, in any methods claimed herein that include more than one step or act, the order of the steps or acts of the method is not necessarily limited to the order in which the steps or acts of the method are recited.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least of A and B" (or, equivalently, "at least one of A or B," or equivalently, "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively as set forth in the United States Patent Office Manual of Patent Examining Procedures, Section 2111.03.

The foregoing description of several methods and embodiments have been presented for purposes of illustration. It is intended to be exhaustive or to limit the precise steps and/or forms disclosed, and obviously many modifications and variations are possible in light of the above teaching. It is intended that the scope and all equivalents be defined by the claims appended hereto.

What is claimed:

1. A mounting apparatus, comprising:

a mounting panel and at least one utility bracket, the mounting panel including:

a front side and a rear side;

the front side including a plurality of mounting holes and a plurality of apertures, each of the apertures having a first section and a second section;

the first section including at least a pliable locking tab, wherein the pliable locking tab extends within the first section towards the second section, and wherein the pliable locking tab moves between a rest position to a tension position; and the second section including at least one slot for receiving the at least one utility bracket; and the at least one utility bracket including:

a first side and a second side, the first side including at least one mounting mechanism to support an object, and the second side including at least one anchor, the at least one anchor having a central spline and one or more lateral flanges, the at least one anchor configured to move the pliable locking tab from the rest position to the tension position and slide down the at least one slot of the second section, the pliable locking tab holds the at least one anchor in the rest position.

2. The mounting apparatus of claim 1, wherein the rear side of the mounting panel includes a rear cavity.

3. The mounting apparatus of claim 2, wherein the pliable locking tab is received by the rear cavity in the tension position, and wherein the pliable locking tab is substantially parallel to the rear side of the mounting panel in the rest position.

4. The mounting apparatus of claim 1, wherein the plurality of mounting holes on the front side of the mounting panel may be at least one of straight or angled.

5. The mounting apparatus of claim 1, wherein the pliable locking tab is laterally tapered creating a tapered end.

6. The mounting apparatus of claim 5, wherein the tapered end of the pliable locking tab in the rest position holds the at least one anchor of the at least one utility bracket to the mounting panel.

7. The mounting apparatus of claim 1, wherein the second section further includes one or more lead-ins disposed proximate to the at least one slot, the one or more lead-ins extending from the front side of the mounting panel to the rear side of the mounting panel.

8. The mounting apparatus of claim 1, wherein the one or more lateral flanges include a first lateral flange, the first lateral flange laterally extending from the central spline.

9. The mounting apparatus of claim 8, wherein the one or more lateral flanges includes a second lateral flange, the second lateral flange laterally extending from the central spline and substantially opposite the first lateral flange.

10. The mounting apparatus of claim 1, wherein the at least one utility bracket further includes:

the at least one anchor includes a first anchor and a second anchor, where the first anchor includes a first lateral flange laterally extending from the central spline; and the second anchor includes a second lateral flange laterally extending from a second central spline in a substantially opposite direction from the first lateral flange.

11. The mounting apparatus of claim 1, wherein the at least one mounting mechanism is one or more straps to support the object.

12. The mounting apparatus of claim 1, wherein the at least one mounting mechanism is one or more prongs to support the object.

13. The mounting apparatus of claim 1, wherein the at least one mounting mechanism is a cavity to support the object.

14. A mounting panel, comprising:

a front side and a rear side, wherein the front side includes a plurality of mounting holes and a plurality of apertures, each of the apertures having a first section and a second section, and wherein the rear side includes a rear cavity;

the first section including at least a pliable locking tab, wherein the pliable locking tab extends within the first section towards the second section, and wherein the pliable locking tab moves between a rest position to a tension position; and the second section including at least one slot for receiving at least one utility bracket, wherein the pliable locking tab has a first lateral side and a second lateral side, at least one of the first lateral side and second lateral side is laterally tapered creating a tapered end, wherein the tapered end of the pliable locking tab is adjacent the intersection of the first section and the at least one slot of the second section in the rest position, and wherein the tapered end of the pliable locking tab is received by the rear cavity when in the tension position;

wherein in combination with the at least one utility bracket, comprises:

a first side and a second side;

the first side including at least one mounting mechanism to support and object; and the second side including at least one anchor, the at least one anchor having a central spline and one or more lateral flanges, the at least one anchor moves the pliable locking tab from the rest position to the tension position to be received by the at least one slot of the second section.

15. The mounting panel of claim 14, wherein when the tapered end is in the tension position away from the at least one slot the at least one utility bracket is removed from the at least one slot of the second section of the aperture.

16. The mounting panel of claim 15, wherein the at least one mounting mechanism is one of: one or more straps to support the object, one or more prongs to support the object, and one or more straps to support the object.

17. The mounting panel of claim 15, wherein the second section further includes one or more lead-ins disposed proximate to the at least one slot, the one or more least one lead-ins extending from the front side of the mounting panel to the rear side of the mounting panel, and the one or more lead-ins configured to receive one or more of the lateral flanges.

18. A method of using a mounting apparatus, comprising:

securing a mounting panel to a surface, by a plurality of mounting holes, the plurality of mounting holes disposed through the mounting panel, the mounting panel including:

a front side, a rear side, a rear cavity, and a plurality of apertures, each of the plurality of apertures having an first section and a second section;

the first section including at least a pliable locking tab, the pliable locking tab extending within the first section towards the second section and moveable between a rest position to a tension position, and the pliable locking tab is laterally tapered creating a tapered end; and the second section of each of the apertures including a slot;

inserting at least one utility bracket into one or more of the plurality of apertures towards the slot by moving the pliable locking tab to the tension position, wherein the at least one utility bracket includes a first side and a second side, the first side having at least one mounting mechanism to support an object, and the rear side having at least one anchor including a central spline and one or more lateral flanges; and locking the at least one utility bracket within the second section when the pliable locking tab is in the rest position.

19. The method of claim 18 further comprising the step of removing the at least one utility bracket from the second section by moving the pliable locking tab to the tension position.

* * * * *